US006391121B1

(12) United States Patent
Sivacoe

(10) Patent No.: US 6,391,121 B1
(45) **Date of Patent: *May 21, 2002**

(54) METHOD OF CLEANING A HEATER

(75) Inventor: Orlande Sivacoe, Red Deer (CA)

(73) Assignee: On Stream Technologies Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/483,496

(22) Filed: Jan. 14, 2000

Related U.S. Application Data

(63) Continuation of application No. 08/961,574, filed on Oct. 31, 1997, now Pat. No. 6,170,493.

(51) Int. Cl.[7] ..... B08B 9/04

(52) U.S. Cl. ..... 134/8; 134/22.1; 134/22.11; 134/22.12; 165/5; 165/11.1; 165/279; 15/3.5; 15/3.51

(58) Field of Search ..... 134/8, 22.11, 22.12, 134/22.1; 165/5, 11.1, 279; 15/3.5, 3.51

(56) References Cited

U.S. PATENT DOCUMENTS

| | | | |
|---|---|---|---|
| 864,544 | A | 8/1907 | Kessler |
| 1,547,440 | A | 7/1925 | Penn |
| 1,597,850 | A | 8/1926 | Weis |
| 1,668,438 | A | 5/1928 | Weis |
| 1,673,890 | A | 6/1928 | Smith |

(List continued on next page.)

FOREIGN PATENT DOCUMENTS

| | | |
|---|---|---|
| AU | 57790/90 | 3/1991 |
| CA | 1147106 | 5/1983 |
| CA | 1290110 | 10/1991 |
| CA | 2087122 | 7/1994 |
| EP | 0234072 A1 | 2/1986 |

(List continued on next page.)

OTHER PUBLICATIONS

Declaration of Shiuchi Wada, Oct. 15, 1996.
Decarbonization, PEC, System, Oct. 1984.
PEC–PIG Decoking System For Your B–2 Furnace/Exxon, PEC International (USA), Inc., Jan. 15, 1988.
Proposal For PIG Decoking/Furnace PV–F–01, PEC International (USA), Inc., Mar. 6, 1990.
Finding the basic design for your application, Herbert L. Berman, Caltex Petroleum Corp., Chemical Engineering, Jun. 19, 1978, p. 99–170.
UCISCO, A Linde Service Company, brochure entitled "Sandjet Furnace Tube Cleaning—An Energy Conservation Tool", Gary E. Diehl, Union Carbide Industrial Services, Houston, Texas, presented at Phillips Energy Conservation Seminar, Bartlesville, Oklahoma, Apr. 14, 1982, 7 pages.
Computer Search dated Feb. 9, 1997, 4 pages, "decok".
Abstract of U.S. Patent 4,917,787, issued Apr. 17, 1990, 2 pages.
Abstract of U.S. Patent 5,183,642, issued Feb. 2, 1993, 2 pages.
Information Sheet on CHORE BOY™ scouring puff, referencing sale of a product in Canada prior to filing of instant application.

*Primary Examiner*—Randy Gulakowski
(74) *Attorney, Agent, or Firm*—Christensen O'Connor Johnson Kindness PLLC

(57) ABSTRACT

A method of cleaning tubing in an operating heater, in which the tubing has an inlet and an outlet. While the heater is in operation, a pig is run through the tubing from the inlet to the outlet and then returned to the inlet along return tubing, in parallel connection to the heater tubing. A combined pig launcher and receiver mounted parallel to the tubing, and controlled with three way full port valves, is used to launch pigs into the tubing and remove them from the tubing. A boost pump is used to force pigs back from outlet to inlet.

14 Claims, 2 Drawing Sheets

U.S. PATENT DOCUMENTS

| | | | | | |
|---|---|---|---|---|---|
| 1,683,429 | A | | 9/1928 | Walker | |
| 1,713,895 | A | | 5/1929 | Ford | |
| 1,795,348 | A | | 3/1931 | Schmidt | |
| 2,170,997 | A | | 8/1939 | Griffin | |
| 3,425,083 | A | | 2/1969 | Wennerberg et al. | |
| 3,460,180 | A | | 8/1969 | Girard | |
| 3,474,479 | A | | 10/1969 | Girard | |
| 3,939,519 | A | | 2/1976 | Muirhead | |
| 4,077,079 | A | | 3/1978 | Knapp | |
| 4,079,782 | A | | 3/1978 | Solderberg et al. | |
| 4,124,065 | A | | 11/1978 | Leitner et al. | |
| 4,244,072 | A | | 1/1981 | Dunham et al. | |
| 4,283,807 | A | | 8/1981 | Bizard | |
| 4,297,147 | A | | 10/1981 | Nunciato et al. | |
| 4,350,202 | A | | 9/1982 | Schulz et al. | |
| 4,353,414 | A | | 10/1982 | Leitner | |
| 4,383,346 | A | | 5/1983 | Bochinski et al. | |
| 4,390,058 | A | | 6/1983 | Otake et al. | |
| 4,406,031 | A | | 9/1983 | Eimer et al. | |
| 4,420,038 | A | | 12/1983 | Okouchi et al. | |
| 4,435,872 | A | | 3/1984 | Leikam | |
| 4,476,917 | A | | 10/1984 | Otake et al. | |
| 4,538,316 | A | | 9/1985 | Reinhart et al. | |
| 4,556,102 | A | | 12/1985 | Bochinski et al. | |
| 4,566,533 | A | | 1/1986 | Bochinski et al. | |
| 4,709,719 | A | | 12/1987 | Littleton et al. | |
| 4,830,099 | A | | 5/1989 | Eimer | |
| 5,010,950 | A | | 4/1991 | Voith | |
| 5,150,493 | A | * | 9/1992 | Sivacoe | 15/104.061 |
| 5,153,963 | A | | 10/1992 | Saxon et al. | |
| 5,176,199 | A | | 1/1993 | Czolkoss | |
| 5,186,815 | A | | 2/1993 | Lenglet | |
| 5,213,623 | A | | 5/1993 | Burtner | |
| 5,358,573 | A | | 10/1994 | Sivacoe | |
| 5,379,475 | A | | 1/1995 | Sivacoe | |
| 5,431,545 | A | | 7/1995 | Knight et al. | |
| 5,473,787 | A | | 12/1995 | Echols | |
| 5,592,990 | A | | 1/1997 | Ben-Dosa | |
| 5,607,513 | A | | 3/1997 | Sims | |
| 5,630,471 | A | | 5/1997 | Taprogge | |
| 5,647,428 | A | | 7/1997 | Echols | |
| 5,685,041 | A | | 11/1997 | Sivacoe | |
| 5,882,428 | A | * | 3/1999 | Gawne | 134/8 |
| B16,170,493 | B1 | * | 1/2001 | Sivacoe | 134/8 |

FOREIGN PATENT DOCUMENTS

| | | | |
|---|---|---|---|
| EP | 0 371 859 | | 6/1990 |
| EP | 0 371 859 | A1 | 6/1990 |
| EP | 0 646 423 | A1 | 4/1995 |
| FR | 643 717 | A | 9/1928 |
| FR | 1 089 182 | | 9/1954 |
| FR | 1 289 600 | A | 2/1962 |
| FR | 75 20129 | | 6/1975 |
| GB | 780093 | | 7/1957 |
| GB | 844116 | | 4/1960 |
| GB | 845338 | | 8/1960 |
| GB | 893801 | | 4/1962 |
| GB | 1423132 | | 1/1976 |
| GB | 2175666 | A | 5/1986 |
| JP | 57-14192 | | 1/1982 |
| JP | 58-78098 | | 5/1983 |
| JP | 58-184500 | | 10/1983 |
| JP | 59-215599 | | 12/1984 |
| JP | 404349986 | * | 12/1992 |
| WO | WO 91/17843 | | 11/1991 |
| WO | WO99/23438 | * | 5/1999 |

* cited by examiner

METHOD OF CLEANING A HEATER

This application is a continuation of prior application Ser. No. 08/961,574, filed Oct. 31, 1997 now U.S. Pat. No. 6,170,493 priority from the filing date of which is hereby claimed under 35 U.S.C. §120.

FIELD OF THE INVENTION

This invention relates to processes and apparatus used for cleaning heater tubes.

BACKGROUND OF THE INVENTION

Heaters are used in petrochemical installations to heat fluids for a variety of purposes, typically to break apart larger hydrocarbon molecules into smaller molecules, The heaters contain tubes, up to and even more than a kilometer long in each of several passes, that pass first through a convection section of a heater and then through a radiant section. During use, the heater tubes gradually become contaminated on their insides. This contamination, often called coke, tends to degrade the efficiency of the heater over time and can eventually cause the heater to stop working.

Various methods are known for decoking heaters. In one method, the heater is shut down and steam cleaned with high pressure steam. In another method, described for example in U.S. Pat. No. 5,358,573 issued Oct. 25, 1994, by the same inventor, the heater is shut down and pigs with appendages run through the heater until it is clean. In another method, described in U.S. Pat. No. 5,186,815 issued Feb. 16, 1993, the heater tubes are treated while the heater is in operation by injecting solid particles of very small size into the heater tubes, recovering the solid particles at the outlet and recirculating the solid particles back to the inlet of the heater.

Use of pigs to clean heater tubes is very effective since the pigs have a robust scraping action. Heater operators in South America who have used the inventor's method described in U.S. Pat No. 5,358,573 have asked the inventor to provide cleaning of the heater tubes by pigs while the heater is in operation. The inventor has thus come up with a novel solution to the problem of providing a heater cleaning operation by using pigs while a heater is in operation.

SUMMARY OF THE INVENTION

It is an object of this invention to provide a method and apparatus for pigging an operating heater. It is a further object of this invention to provide a pig launcher and receiver connected in parallel with tubing.

Therefore, there is provided in accordance with one aspect of the invention a method of cleaning tubing in an operating heater, in which the tubing has an inlet and an outlet, the method comprising repeating the steps of:

(A) while the heater is in operation, running a pig through the tubing from the inlet to the outlet; and (B) returning the pig to the inlet along return tubing, in parallel connection to the heater tubing.

In accordance with a further aspect of the invention, a boost pump is connected to the return tubing via a boost pump connection pipe to provide pressure for returning the pig to the inlet.

In accordance with a further aspect of the invention, a pig is launched into one of the heater tubing and the return tubing by use of a pig launcher mounted parallel to the one of the heater tubing and the return tubing.

In accordance with a further aspect of the invention, the method further comprises removing the pig from one of the heater tubing and the return tubing with a pig receiver mounted parallel to the one of the heather tubing and the return tubing.

In accordance with a further aspect of the invention, a single combined pig launcher and receiver functions as the pig launcher and the pig receiver.

In accordance with a further aspect of the invention, the return tubing is closed by a return valve while the pig is running through the heater tubing, and the return valve is opened after the pig passes the boost pump connection pipe.

In accordance with a further aspect of the invention, the return tubing is connected to the outlet of the heater at a junction, and an outlet valve is provided on the outlet downstream of the junction, and the method further comprises the step of closing the outlet valve after the pig passes the boost pump connection pipe.

In accordance with a further aspect of the invention, when a pig enters the inlet to the heater tubing, after passing through the return tubing, the return valve is closed and the outlet valve is opened.

In accordance with a further aspect of the invention, there is provided apparatus for pigging heater tubing in an operating heater, the heater tubing having inlet tubing and outlet tubing. Return tubing is connected to the inlet tubing at a first junction and to the outlet tubing at a second junction. A boost pump is connected to the outlet tubing by a boost pump connection pipe. Pig launching and receiving equipment is connected for launching of pigs into and removal of pigs from the heater tubing and return tubing. An outlet valve is provide on the outlet tubing downstream of the second junction. A first pig tripper is provided on the outlet tubing downstream of the boost pump connection pipe. A return valve is provided on the return tubing. A second pig tripper is provided near the inlet tubing for detecting when the pig is close to the inlet tubing.

In accordance with a further aspect of the invention, the pig launching and receiving equipment comprises a pig launcher mounted parallel to one of the heater tubing and the return tubing; and a pig receiver mounted parallel to one of the heater tubing and the return tubing.

In accordance with a further aspect of the invention, there is provided a pig launcher and receiver comprising tubing in which fluids may flow; and a pig launcher and receiver body, the pig launcher and receiver body having an interior cavity for receiving pigs, and a motive fluid inlet and a motive fluid outlet, and a door for removal of pigs from and insertion of pigs into the pig launcher and receiver body. A basket is provided in the pig launcher and receiver body for holding pigs. An inlet pipe controlled by an inlet valve, preferably a three way full port valve, is connected to the tubing at a first Y junction and connected to the motive fluid inlet. An outlet pipe controlled by an outlet valve, preferably a three way full port valve, is connected to the tubing at a second Y junction and connected to the motive fluid outlet.

Preferably, the motive fluid outlet and the motive fluid inlet are located at opposite ends of the interior cavity.

In accordance with a further aspect of the invention, there is provided a method of cleaning a tube in an operating heater, wherein the tube has an inlet and an outlet and fluid being heated is flowing from the inlet to the outlet, the method comprising the steps of:

monitoring the temperature at the outlet of the tube; and when the temperature at the outlet of the tube indicates a degradation of efficiency of the heater below a given set point, running a pig through the tube to clean the tube while the heater is operating.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
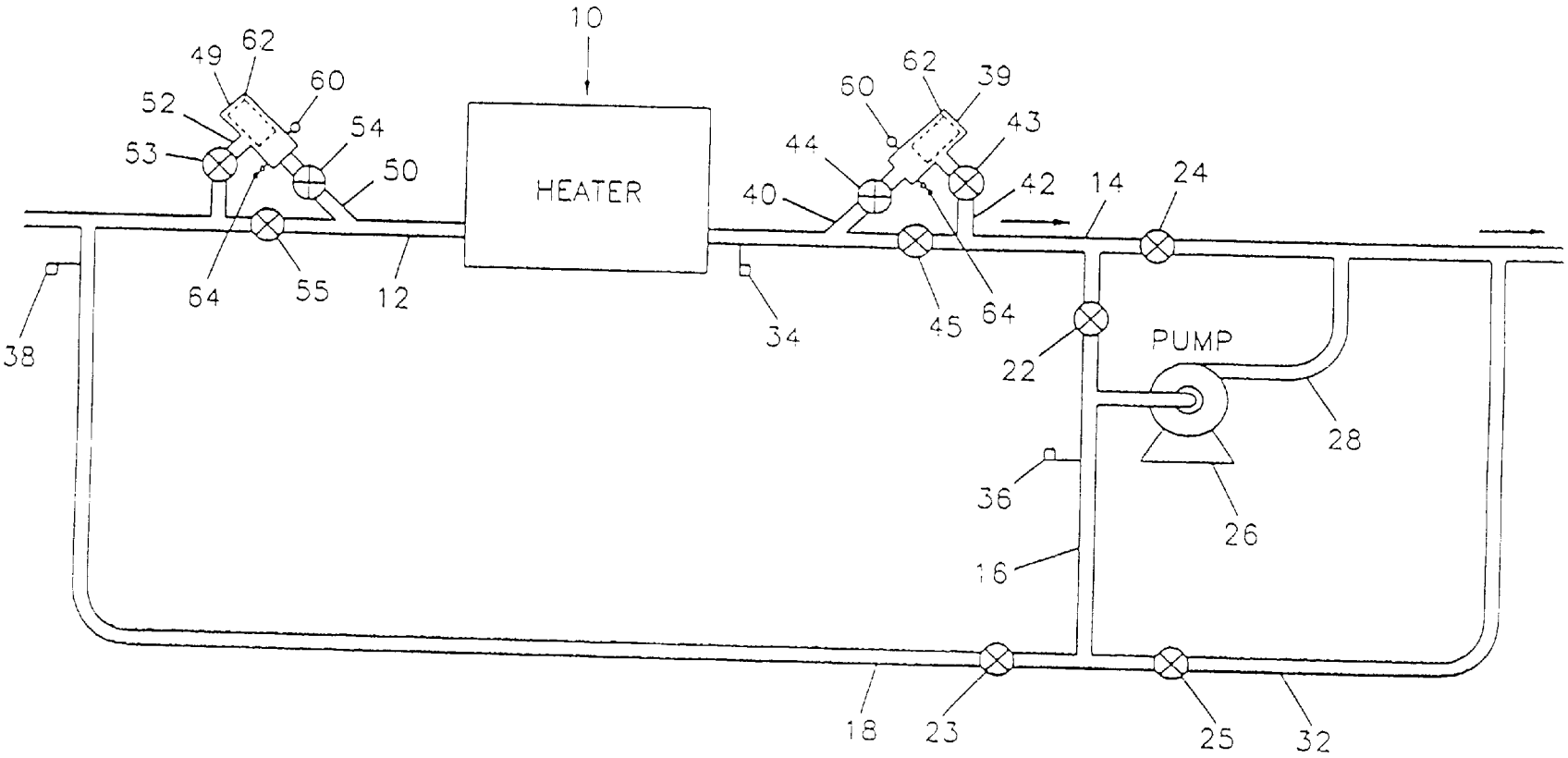
FIG. 1 is a schematic showing the manner of operation of continuous cleaning of a heater while the heater is in operation.

Referring to FIG. 1, a heater 10 may contain as much as 10 kilometers of tubing or pipe running through a convection section and a radiant section from an inlet tube 12 to an outlet tube 14 in several passes. Details of the heater are not shown since the invention is intended for application to existing installations, the general construction of which is well known. The invention is intended for cleaning of the tubing in the heater while fluid being heated is flowing through the heater from the inlet tube 12 to the outlet tube 14. To enable automatic operation of the system according to an embodiment of the invention, a return tube formed of tubes 16 and 18 in parallel with the heater tubes is provided between the outlet 14 and inlet 12, with a control valve 22 on tube 16 and return control valve 23 on tube 18. A boost pump 26 on a boost pipe 28 is connected to supply boost fluid to the tube 16. A bypass tube 32 which also forms part of the outlet tubing is also connected in parallel to the boost pipe 28 between the tube 16 and outlet 14. A valve 24 is provided on tube 14, and an outlet valve 25 is provided on tube 32 downstream of the junction between the tube 16 and return tubing 18. Trippers 34, 36 and 38 are provided on tubes 14, 16 and 18 respectively. The trippers 34, 36 and 38 are conventional pig trippers that are activated when a pig passes them. Tripper 38 should be located close to the junction of return tubing 18 with the inlet tubing 12. Close or near in this context means in position where it can be determined when the pig enters the inlet tubing 12. This need not be at the junction if a timer is used and it is known how long it takes for the pig to travel from the tripper 34 to the junction of return tubing 18 and inlet tubing 12. Tripper 34 should be located close to and upstream of the pig launcher 39.

A conventional pig receiver 39 is attached to the tube 14 in parallel by tubes 40, 42 and controlled by valves 43, 44 and 45. The parallel construction permits fluid to flow either through the tube 14 or the pig receiver 39 depending on the positioning of the valves 43, 44 or 45. Pig receiver 39 is used for removal of pigs from the tube. A conventional pig launcher 49 is attached to the tube 12 in parallel by tubes 50, 52 and controlled by valves 53, 54 and 55. The parallel construction permits fluid to flow either through the tube 12 or the pig launcher 49 depending on the positioning of the valves 53, 54 or 55. Pig launcher 49 is used for launching of pigs into the tube. The pig launcher and receiver may be connected to any tube that connects into the tubes 12, 14, 16 or 18, and is preferably on one of the tubes 12, 14, 16 or 18.

Figure 2:
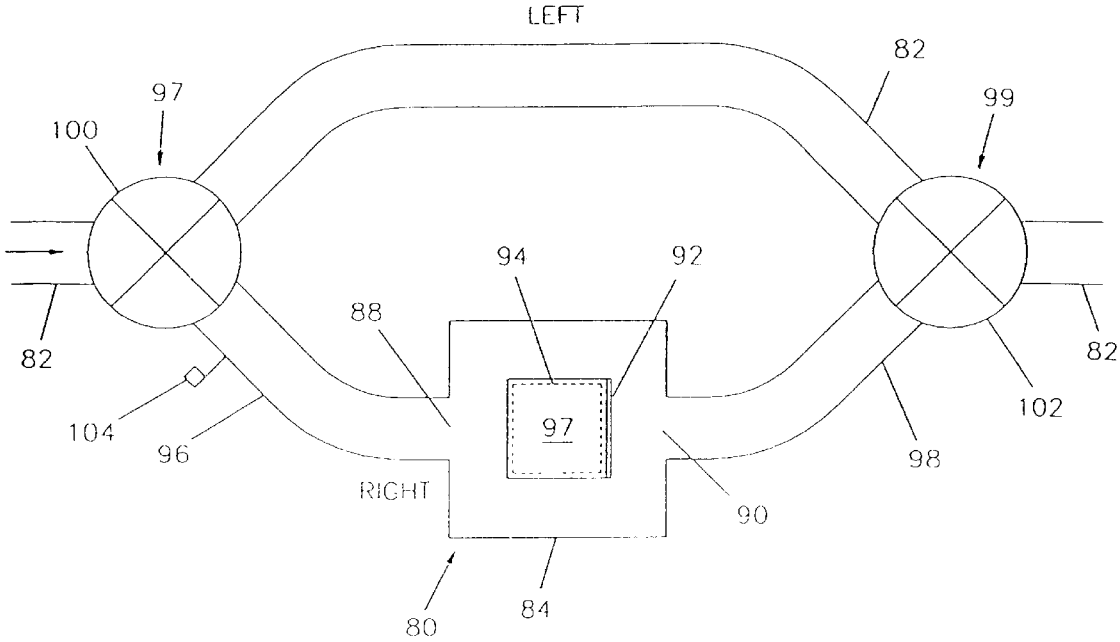
FIG. 2 is a section through a combined pig launcher and receiver that for example may be used in the operation of the invention.

An alternative pig launcher and receiver design is shown in FIG. 2. In this embodiment, there is provided a combined pig launcher and receiver 80, that is mounted parallel to a set of tubing 82 in which fluids may flow, which may for example be the inlet or outlet tubing of a heater or the return tubing 18. The pig launcher and receiver 80 is formed of a pig launcher and receiver body 84, having an interior cavity 86 for receiving pigs. Preferably on opposed sides of the interior cavity 86 there is provided a motive fluid inlet 88 and a motive fluid outlet 90. A door 92 is provided for removal of pigs from and insertion of pigs into the pig launcher and receiver body 80. A basket 94 is installed in the pig launcher and receiver body 80 for holding pigs. Except as described here, the design of the pig launcher and receiver follows conventional design. An inlet pipe 96 is connected to the tubing 82 at a Y junction 97 and connected to the motive fluid inlet 88. An outlet pipe 98 is connected to the tubing 82 at a Y junction 99 and connected to the motive fluid outlet 90. A three way full port valve 100 is provided on the inlet pipe at the Y junction 97. A three way full port valve 102 is provided on the outlet pipe at the Y junction 99. A tripper 104 is provided on the tubing 82 upstream of the pig launcher and receiver 80.

This alternative pig launcher and receiver design works as follows. The three way full port valves 100 and 102 may direct flow and a pig carried by the flow into the pig launcher and receiver 80 or around the pig launcher and receiver 80 through tubing 82. When the heater tubing is not being cleaned, or a pig is by-passing the pig launcher and receiver 80 valves 100 and 102 are in left open position (tubing 82 is open). When a pig is in the system and needs to be stopped, three way valves 100 and 102 are placed into right position. When the tripper 104 signals a pig has arrived at the pig launcher and receiver 80, the valves 100 and 102 return to left open position. One combined pig launcher and receiver is used for each pass in a heater.

In the normal operating condition, the inlet 12 is at a lower temperature and higher pressure than the outlet 14, and with no pigs in the system, valves 22 and 25 are open, and valves 23 and 24 closed, permitting flow through tubes 14, 16 and 32 which together form an outlet tube. When it is desired to operate the system with a pig, a pig is injected into line 14 through pig launcher 49. To do this, valves 53 and 54 on tubes 52 and 50 respectively are closed, with valve 55 on tube 12 open. A pig may then be placed in the launcher 49. Valves 53 and 54 are opened and then valve 55 on tube 12 is closed, forcing the pig into tube 12 and into the heater 10. The pig exits the heater through tube 14, and since valve 24 is closed, the pig passes into line 16 and trips tripper 36 which is located on the tubing 16 downstream of the junction of the boost pump connection pipe 28 with the tubing 16. When the pig trips tripper 36, valves 23 and 24 are opened, valves 22 and 25 are closed and boost pump 26 is started. The boost pump 26 provides the required pressure to force the pig to return to the inlet 12 past tripper 38. For an exemplary inlet pressure of 150 psi, and outlet pressure of 110 psi, the boost pump pressure is 200 psi.

When tripper 38 is tripped, boost pump 26 is shut off, valves 22 and 25 are opened and valves 34 and 24 are closed, thus completing the cycle automatically. While pigs are being shunted around the system automatically, the valve 45 is kept open and valve 44 closed. When it is desired to remove pigs from the system, for example for inspection of the pigs, upon tripping of tripper 34 by a pig, valve 45 is closed, and valves 43 and 44 opened, permitting the pig to enter the pig launcher. Valve 45 may then be opened and valves 43 and 44 closed, and the pig may be removed from the launcher.

Each of the pig launcher 49 and pig receiver 39 contains a basket 62 and pressure gauge 60. The basket permits fluid flow through the receiver, while the pig may be caught before or in the basket. The pressure gauges 60 inform an operator that the pressure is low enough for the door of the launcher and receiver to be opened. A drain valve 64 is provided in each of the launcher and receiver to permit draining of fluids. The inside diameter of the launcher and receiver should be two sizes larger than the clean inside diameter of the tube being treated. For example, a launcher and receiver inside diameter of 5 or 6 inches would be used for treatment of a 4 inch tube. The launcher and receiver should be made of metal having similar metallurgical properties to the metal of the heater tubes being treated. A door (not shown) is provided on the launcher or receiver in conventional fashion.

In a preferred manner of operation of the invention, the automatic cleaning of the heater tube may be effected whenever there is a degradation of efficiency of the heater. Efficiency of the heater may be monitored by monitoring the temperature at the outlet 14 of the heater 10 with a conventional temperature sensor. For a given heat input to the heater 10, the fluid in the tube will be heated a lesser amount when there is a greater amount of contamination in the tube. The contamination in effect acts as an insulator for the fluid in the tube. Hence, when the temperature at the outlet 14 of the heater 10 indicates a degradation of efficiency of the heater 10 below a given set point, a pig may be run through the tube in the manner described to clean the tube while the heater is operating.

The tubes, valves and launchers should all be made of similar metal to the metal in the heater tubes. The pigs may be made of similar metal, or may be made from elastic polymer that is capable of withstanding the temperatures in the heater. The pigs must be able to bend sufficiently to move around the bends in the tubes, and must also be strong enough to retain cleaning devices such as bolts, studs, grit, and other conventional cleaning elements in the pig to effect a cleaning action. Exemplary cleaning devices are shown in U.S. Pat. No. 5,265,302. The appendages should also be made of similar metal to the tubes. Exemplary polymers for moderate temperature applications include the following materials: ETFE Fluropolymer (Tefzel™), a melt processable fluropolymer available from Dupont; LCP (Polyester Liquid crystal Polymer), under the tradename Vectra™, Xydar™, available from Amoco, Hoechst Celanese, respectively. LCPs are relatively new materials with unusual properties, whose strength is in the skin. Good design data is not available for these materials, so prototyping is a must: prototypes must be molded, because of the molecular orientation mentioned above. Other materials that may be used include PEEK Polyetheretherkeytone, known as Victrex™, Thermocomp™ available from ICI, LNP respectively; PEI Polyetherimid, known as Ultem™ available from GE; PES Polyethersulfone, known as Thermocomp™, Victrex™ available from LNP, ICI respectively; Polyimide thermoplastic, known as Aurum™ available from Mitsui Toatsu; PPA Polyphthalamide, known as Amodel™, Verton™ available from Amoco, LNP respectively; PPS Polyphenylene Sulfide, known as Fortron™, Lubricomp™, Ryton™, Supec™ available from GE, Hoechst Celanese, LNP Phillips, respectively; Polysulfone, known as Udel and Mindel™ available from Amoco. Design data on these materials is available from their manufacturers.

So far as known to this inventor, some of these moderate temperature polymers are satisfactory for operation up to about 500° F. Above this temperature, metallic pigs are currently believed to be required. However, it is believed that as other polymers become available the process described herein will operate at higher temperatures with polymer based pigs.

Figure 3:
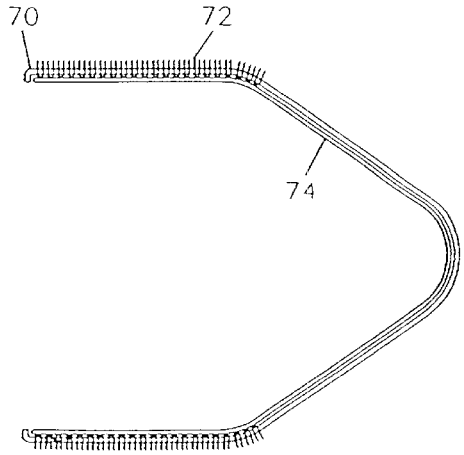
FIG. 3 is a section through a pig that may be used during the operation of the invention.

An exemplary metallic pig is shown in FIG. 3. An exterior partly cylindrical and partly conical shell 70 is made of spring metal of the same material that the tubes in the heater are made from, or such other material that will withstand the high temperature corrosive conditions within the heater tubes. Bristles or metallic wires 72 acting as cleaning elements are formed into U-shapes and pass through openings in the cylindrical portion of the shell 70 in conventional fashion for forming a brush with bristles. The metallic wires 72 extend circumferentially around the cylindrical portion of the conical shell 70. Other methods of securing the wires 72 may be used. An interior cylindrical and conical shell 74 of similar but slightly smaller cross-section than the conical shell 70 is pressed into the conical shell 70 to assist in securing the metallic wires 72 in the conical shell 70. An annular lip 76 holds the interior shell 74 inside the exterior shell 70. The metallic wires 72 and the shell 74 should be made of the same material as the shell 70 or a material having equivalent characteristics.

Another embodiment of a metallic pig is shown in United Kingdom patent specification no. 844,116 published Aug. 10, 1960, and also in United Kingdom patent application no. 2,175,666. These metallic pigs are believed to have utility when used in the method of the invention, but are not believed to be as effective a cleaning device as the well known polymer based pigs with hard cleaning elements that are described for example in U.S. Pat. No. 5,265,302. Hence, where polymer based pigs are sufficiently tolerant of high temperatures that they may be used in an operating heater, it is preferred that they be used.

any pig used in the operation of the invention should be dimensioned to fit within the tube with its cleaning elements able to compress against contaminants in the tube and effect a scraping action. The pig itself is constructed to bias the cleaning elements against the contaminants.

While the system may be manually operated, it is preferred to operate the system automatically. For this purpose, a control system may be connected to the trippers, valves, boost pump and pig launcher and receiver for controlling their operation in accordance with the operating principles outlined herein. Other than as described, the tubing, trippers, valves, and boost pump mentioned herein are all conventional.

It should be appreciated that the drawing shown is not to scale. In practice, both inlet 12 and outlet 14 may pass out of the heater in close proximity to each other, and thus the return tubing 18 may be a very short length.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A method of cleaning heater tubing in an operating heater, in which the heater tubing has an inlet and an outlet, the method comprising repeating the steps of:

(a) while the heater is in operation, running a pig through the heater tubing from the inlet to the outlet, the pig being dimension to fit compressed within the heater tubing; and (b) returning the pig to the inlet along a return tubing, in parallel connection to the heater tubing, the return tubing being connected to a boost pump via a boost pump connection pipe to provide pressure for returning the pig to the inlet, and said return tubing being closed by a return valve while the pig is running through the heater tubing, and the return valve is opened after the pig passes the boost pump connection pipe.

2. The method of claim 1 in which the return tubing is connected to the outlet of the heater tubing at a junction, and an outlet valve is provided on the outlet downstream of the junction, and the method further comprises the step of:

closing the outlet valve after the pig passes the boost pump connection pipe.

3. The method of claim 1 in which a pig is launched into one of the heater tubing and the return tubing by use of a pig launcher mounted parallel to the one of the heater tubing and the return tubing.

4. The method of claim 2 in which, when a pig enters the inlet to the heater tubing, after passing through the return tubing, the return valve is closed and the outlet valve is opened.

5. The method of claim 3 further comprising removing the pig from one of the heater tubing and the return tubing with a pig receiver mounted parallel to the one of the heater tubing and the return tubing.

6. The method of claim 5 in which a single combined pig launcher and receiver functions as the pig launcher and the pig receiver.

7. A method of cleaning heater tubing in an operating heater, in which the heater tubing has an inlet and an outlet, the method comprising:

(a) running a pig through the heater tubing from the inlet to the outlet while the heater is in operation, the pig being dimensioned to fit compressed within the heater tubing;

(b) returning the pig to the inlet along a return tubing, in parallel connection to the heater tubing;

(c) removing the pig from one of the heater tubing and the return tubing with a pig receiver mounted parallel to the one of the heater tubing and the return tubing; and in which a boost pump is connected to the return tubing via a boost pump connection pipe to provide pressure for returning the pig to the inlet, and said pig being launched into one of the heater tubing and the return tubing by use of a pig launcher mounted parallel to the one of the heater tubing and the return tubing, and a single combined pig launcher and receiver functions as the pig launcher and the pig receiver, and the return tubing is closed by a return valve while the pig is running through the heater tubing, and the return valve is opened after the pig passes the boost pump connection pipe.

8. The method of claim 7 in which the return tubing is connected to the outlet of the heater tubing at a junction, and an outlet valve is provided on the outlet downstream of the junction, and the method further comprises the step of:

closing the outlet valve after the pig passes the boost pump connection pipe.

9. The method of claim 8 in which, when a pig enters the inlet to the heater tubing, after passing through the return tubing, the return valve is closed and the outlet valve is opened.

10. A method of cleaning heater tubing in an operating heater through which a fluid flows in which the heater tubing has an inlet an outlet, the method comprising repeating the steps of:

(a) while the heater is in operation, running a pig through the heater tubing from the inlet to the outlet, the pig being dimensioned to fit compressed within the heater tubing; and (b) returning the pig to the inlet along a return tubing, in parallel connection to the heater tubing, and the temperature of the fluid flowing through the tubing is in excess of 500° F.

11. A method of cleaning tubing in an operating heater through which a fluid flows, in which the tubing has an inlet and an outlet, the method comprising running a pig through the tubing from the inlet to the outlet while the heater is in operation, the pig being dimensioned to fit compressed within the tubing, and returning the pig to the inlet, and the temperature of the fluid flowing through the tubing is in excess of 500° F.

12. The method of claim 11 in which the heater has a convection section and a radiant section, and the pig is run through tubing in both the convection section and the radiant section.

13. The method of claim 11 in which the pig is made entirely of metal.

14. A method cleaning tubing in an operating heater through which a fluid flows, the tubing having an outlet and an inlet, the method comprising the steps of:

(a) operating the heater with the fluid to be heated flowing through the tubing at a temperature in excess of 500° F; and (b) selectively cleaning the operating heater while the fluid to be heated flows through the tubing, by:

(i) launching a pig into the tubing of the heater;

(ii) running the pig through the tubing of the operating heater from the inlet to the outlet at least one pass with the pig compressed within the tubing; and (iii) removing the pig from the tubing of the operating heater.

* * * * *

UNITED STATES PATENT AND TRADEMARK OFFICE

CERTIFICATE OF CORRECTION

PATENT NO. : 6,391,121 B1
DATED : May 21, 2002
INVENTOR(S) : O. Sivacoe

It is certified that error appears in the above-identified patent and that said Letters Patent is hereby corrected as shown below:

Title page,
Item [56], References Cited, U.S. PATENT DOCUMENTS, "B16,170,493 B1" should read -- 6,170,493 B1 --

Column 8,
Line 11, "fluid flows in" should read -- fluid flows, in --
Line 12, "an inlet an outlet" should read -- an inlet and an outlet --
Line 46, sub-indent the subparagraph beginning "(ii) running the pig through the tubing"
Line 47, "one pass with" should read -- one pass, with --

Signed and Sealed this

Twenty-eighth Day of January, 2003

JAMES E. ROGAN
*Director of the United States Patent and Trademark Office*